US005152231A

United States Patent [19]

Preston et al.

[11] Patent Number: 5,152,231

[45] Date of Patent: Oct. 6, 1992

[54] FIRE-RESISTANT SAFE

[75] Inventors: Mark E. Preston, Fairport; Eugene S. Stephens, Ontario, both of N.Y.

[73] Assignee: John D. Brush & Co., Inc., Rochester, N.Y.

[21] Appl. No.: 647,805

[22] Filed: Jan. 30, 1991

[51] Int. Cl.[5] ..... E05G 1/026

[52] U.S. Cl. ..... 109/65; 109/80; 312/409

[58] Field of Search ..... 312/214, 213, 229, 296; 109/65, 80, 82, 83, 84

[56] References Cited

U.S. PATENT DOCUMENTS

| | | | |
|---|---|---|---|
| 2,613,623 | 10/1952 | Behrens . | |
| 2,684,646 | 7/1954 | Henkel . | |
| 3,139,313 | 6/1964 | Rule . | |
| 3,408,966 | 11/1968 | Gartner | 109/80 X |
| 3,855,741 | 12/1974 | Semon . | |
| 4,048,926 | 9/1977 | Brush, Jr. et al. . | |
| 4,263,365 | 4/1981 | Burgess et al. . | |
| 4,272,137 | 6/1981 | Rothhaas et al. | 312/214 |
| 4,307,543 | 12/1981 | Schulthess . | |
| 4,422,386 | 12/1983 | Carpenter | 109/84 X |
| 4,541,545 | 9/1985 | Beattie et al. . | |
| 4,721,227 | 1/1988 | Hughes et al. . | |
| 4,735,155 | 4/1988 | Johnson . | |
| 4,741,276 | 5/1988 | Pollock . | |
| 4,828,786 | 5/1989 | Legge et al. . | |

FOREIGN PATENT DOCUMENTS

| | | |
|---|---|---|
| 149731 | 12/1931 | Switzerland . |
| 1365741 | 9/1974 | United Kingdom . |
| 2168402 | 6/1986 | United Kingdom . |

*Primary Examiner*—Kenneth J. Dorner
*Assistant Examiner*—Brian K. Green
*Attorney, Agent, or Firm*—Eugene Stephens & Associates

[57] ABSTRACT

A fire-resistant safe has a main body and a closure, both of which are formed from integral resin shells filled with insulation materials. When exposed to fire, a portion of the resin material burns away leaving gaps between the insulation materials of the main body and closure. However, formation of convection air currents in vertical sections of the gaps is resisted by reducing spacings between insulation materials of the main body and closure. The amount of heat energy carried by the convection air currents is similarly reduced, thereby avoiding significant concentrations of heat that can promote burning through the gaps.

3 Claims, 3 Drawing Sheets

FIRE-RESISTANT SAFE

BACKGROUND

Fire-resistant safes are designed to protect their contents from exposure to high temperatures of fire for predetermined periods of time. The safes are usually constructed with external and internal shells that encapsulate a space filled with insulating material. The external shell forms the outer surface of the safe and cooperates with the internal shell to form a shuttering for molding the insulation material in place within walls of the safe. The insulation material is generally made of a mixture that solidifies in a mold but retains a large amount of water within the solidified mass of the material.

Fire-resistant safes also have openings for receiving contents; and the openings in safe bodies are closed by doors, drawer heads, or other types of closures for protecting the contents of the safes. The closures may also be constructed with external and internal shells filled with the same insulating material. The openings in the safe bodies are surrounded by a frame that joins the external and internal shells of the safe bodies. Similarly, the external and internal shells of the closures are joined by a peripheral region that fits within the frame of the safe bodies to close the openings in the safes.

The external and internal shells of many fire-resistant safes are made of steel to provide additional structural strength and to conduct heat away from hot spots by dissipating the heat over a larger area of the safes. However, intermediate portions of the steel shells, which form the frames in the safe bodies and the peripheral regions of the closures, conduct heat into the interior of the safes. In addition, the steel shells tend to warp when heated and produce, between the safe openings and the closures, passages that admit hot gasses into the safes.

Other fire-resistant safes have external and internal shells made of a molded resin material. Although the resin material is combustible and burns away from the outer surfaces of the insulation material in a fire, the resin material of the frames and the peripheral regions of the closures only partially melts away leaving a seal between the safe openings and closures. The frames of the safe openings and closures are made deep enough in cross section through the safes so that, after the resin material covering the outer surfaces of the insulation material has burned away, a softened or plasticized portion of the resin material remains in the opening to seal the closures to the safe bodies. The resin seal resists heat conduction and the passage of hot gasses into the safes.

However, since the resin material of the shells exhibits low thermal conductivity in relation to steel, the resin shells do not dissipate as much heat away from hot spots. The corners of the safes are especially vulnerable to "burn through" because the corners are exposed to heat on three sides. Accordingly, additional insulating material is used in the corners of the safes to provide more uniform protection against burn through over the exposed areas of the safes.

In addition to the heat concentrations in portions of the safes exposed to fire from more than one direction, other heat concentrations are evident in front walls of the safes at the top corners of the frames joining jamb members that enclose opposite sides of the openings with a framing member that encloses the top of the openings. Under especially severe conditions, the resin material in the top corners of the frames may be entirely burned away exposing a hole through the resin seal between the safe openings and closures.

SUMMARY OF THE INVENTION

The first-named inventor has discovered a source of the problem of heat concentrations at the top corners of the frames between resin shells of safe openings and closures. This discovery provides a basis for implementing a variety of solutions that would not have been apparent without the discovery.

After the resin material of the external shells burns away, a portion of the resin material is also burned into jamb regions (i.e., in the jamb members of the frame and in the peripheral portions of the closures confronting the jamb members) creating gaps between the insulating material of the safe body and the closure. Although, at least initially, the gaps do not penetrate the resin seal, the gaps burned in the jamb regions provide vertical passageways for movement of air along the jambs. Resin material burning in the jamb regions is believed to induce convection air currents that carry heated air and products of combustion along the jambs producing concentrations of heat at the top corners of the frame.

This phenomena may be referred to as the "chimney effect" because similar to the function of a chimney, the gaps burned in the resin material of the jamb regions are heated by fire and induce vertical drafts of air in the gaps that tend to further promote the fire. However, the vertical air passageways burned in the jamb regions are obstructed at the top of the jambs by the framing member enclosing the top of the opening. Accordingly, the heat and products of combustion carried by the convection air currents rising along the jambs become concentrated at the top corners of the frame and promote burning through the top corners of the frame more rapidly than the remaining portions of the frame.

Our invention is specifically directed to treating the problem of destructive convection air currents in the jamb regions of fire-resistant safes by resisting the formation of air passageways in the jamb regions within which the convection air currents can become established. For example, one embodiment of our invention provides for molding portions of the resin shells of the safe bodies and closures forming the jamb regions significantly thinner than the remaining portions of the resin shells. More particularly, both the jamb members of the frame enclosing the openings in safe bodies and the portions of the closure periphery adjacent to the jamb members are molded much thinner in cross section to narrow a space between the insulation materials that fill the resin shells of the safe bodies and closures. Any gaps between the insulation materials left by burning away resin material on the surfaces of the jamb regions are too narrow to promote significant air flows within the jamb regions. However, the remaining portions of the resin shells are molded with sufficient cross-sectional thickness to provide the necessary structural strength for molding the insulation materials in place within the shells.

Another embodiment of our invention provides for exerting a compressive force between the confronting resin surfaces in the jamb region. At least portions of the frame and of the peripheral region of the closure, including the the confronting surfaces of the jamb region, are oriented to abut one another when the safe is closed. In addition, the closure is biased with respect to the safe body to exert a compressive force between the abutting portions of the safe body and closure. When the resin material in the jamb region is exposed to the heat of fire and begins to soften or melt, the compressive force squeezes the molten resin together to fill any gaps that begin to form in the jamb region between the safe body and the closure.

Both of the just-described embodiments provide for preventing the phenomenon of the chimney effect from becoming established in the jamb regions of fire-resistant safes. In particular, the formation of destructive convention air currents is resisted by either statically or dynamically reducing spacings in the jamb regions between insulation materials enclosed within respective resin shells of the safe body and closure.

However, either of the two examples of our invention may be used in conjunction with other treatments of the chimney effect disclosed in a commonly assigned U.S. Pat. application of the same title filed on even date herewith in the name of the first-named inventor of the present application. This commonly assigned application is hereby incorporated by reference in its entirety.

DRAWINGS

DETAILED DESCRIPTION

Figure 1:
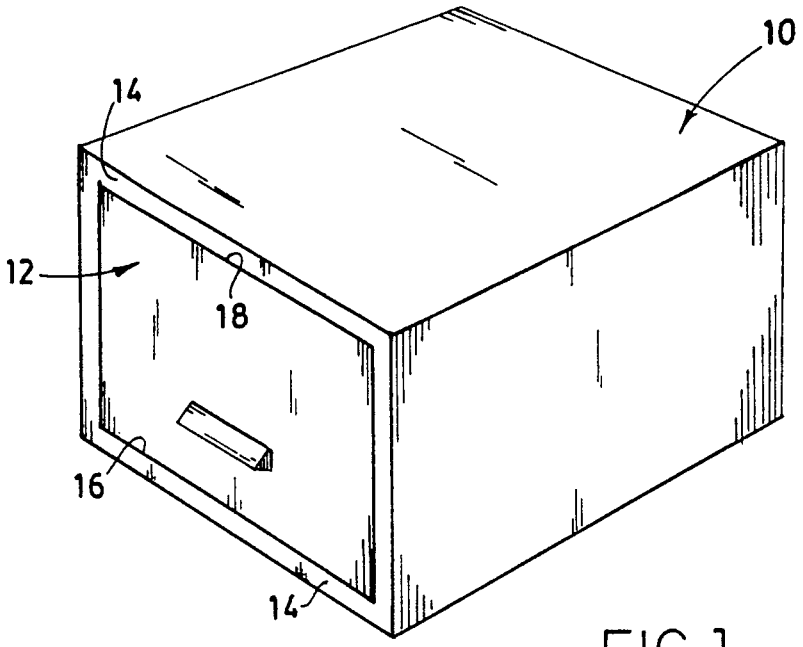
FIG. 1 is a perspective view of a fire-resistant safe in the form of a single drawer file cabinet.

One embodiment of our invention for resisting the formation of air passageways in resin jambs is illustrated by FIGS. 1 through 4. FIG. 1 depicts a fire-resistant safe in the form of a single drawer file cabinet having a main body 10 and a drawer head 12 for closing an opening formed in a front wall 14 of the cabinet. A frame 16 surrounds the opening in the front wall 14, and a peripheral region 18 of the drawer head 12 confronts and fits within the frame 16 for sealing together the main body 10 and drawer head 12.

Figure 2:
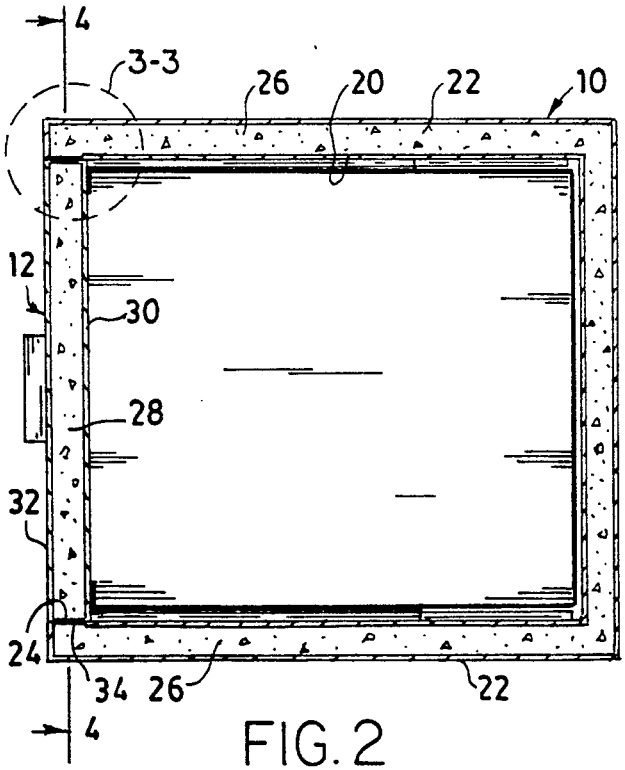
FIG. 2 is a cross-sectional view in a horizontal plane through the cabinet showing integral resin shells of the main body and drawer head respectively filled with insulation materials.
Figure 3:
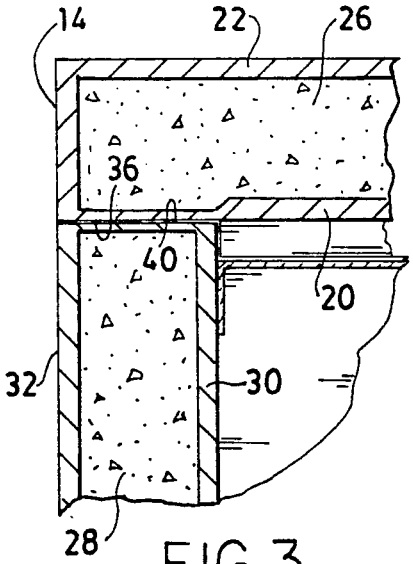
FIG. 3 is an enlarged view of the area designated 3—3 in FIG. 2 showing a reduced thickness of resin material in the jamb regions.

The views of FIGS. 2 and 3 are taken in a horizontal plane cutting through both the main body 10 and the drawer head 12. The main body 10 is formed by an integral resin shell having in inner shell 20, an outer shell 22, and an intermediate shell 24 that enclose a space filled with an insulation material 26. The drawer head 12 is similarly formed by enclosing an insulation material 28 within an integral resin shell also having an inner shell 30, an outer shell 32, and an intermediate shell 34.

Figure 4:
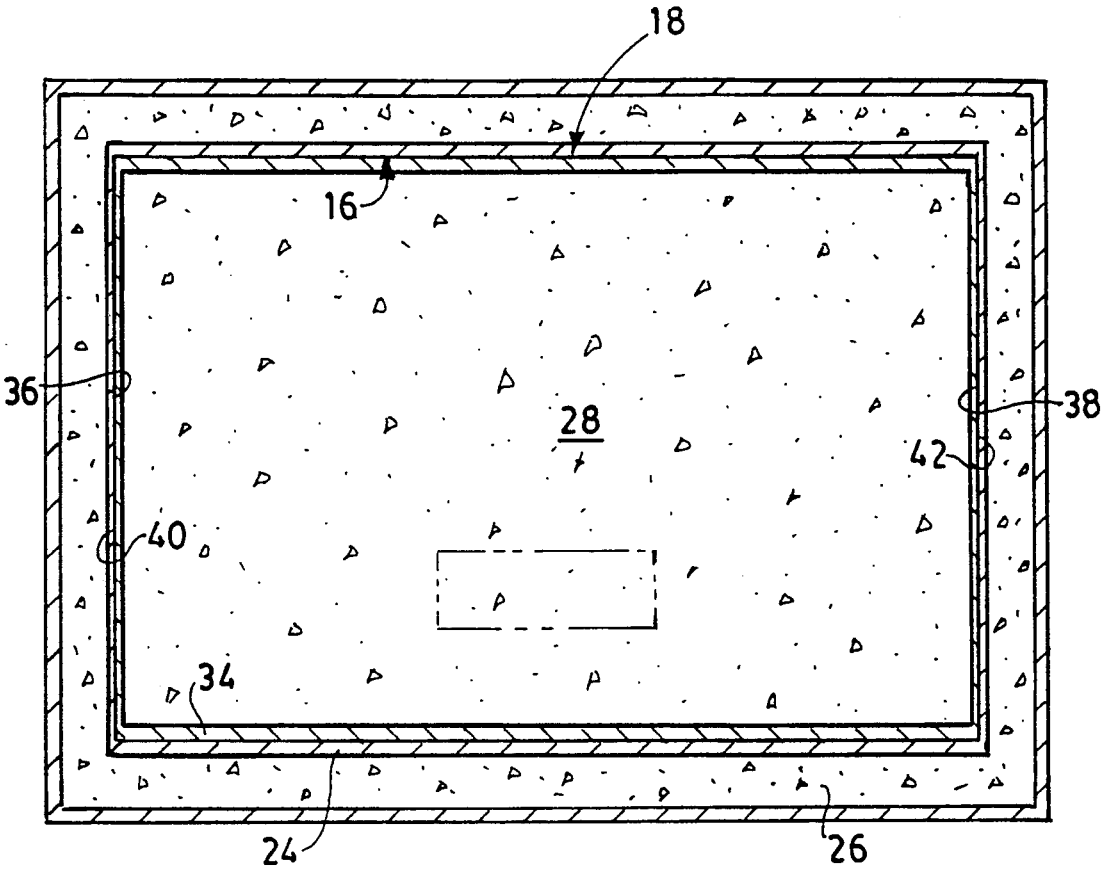
FIG. 4 is a cross-sectional view in a vertical plane taken along line 4—4 of FIG. 2 showing that the reduction in the thickness of the resin material is limited to the jamb regions.

In the front section of the safe shown in FIG. 4, the intermediate shell 24 of the main body can be seen to form jambs 36 and 38 along vertical sides of the frame 16 surrounding the opening in the front wall 14. Confronting portions 40 and 42 of the peripheral region 18 are formed in the intermediate shell 34 of the drawer head and define, together with the jambs 36 and 38, respective jamb regions that extend in a substantially vertical direction.

Although it is a common practice to make fire-resistant safes with safe bodies and closures formed by integral resin shells filled with insulation materials, this embodiment of our invention provides for modifying the structure of the jamb regions to resist the formation of convection air currents within the jamb regions when the depicted cabinet is exposed to fire. Both the jambs 36 and 38 of the main body and the confronting portions 40 and 42 of the drawer head are made substantially thinner in cross section than the inner and outer shells of the main body and drawer head. The reduced thicknesses of the resin jambs and confronting portions permit the respective insulation materials 26 and 28 of the safe body and closure to be separated by a much narrower space in the jamb regions. For example, the enlarged view of FIG. 3 shows that the jamb member 36 and the confronting portion 40 of the drawer head are made much thinner than the adjacent resin material of the integral resin shells of the main body and drawer head. FIG. 4 shows that the reduction in thickness can be limited to the jamb regions, and the remaining portions of the intermediate shells 24 and 34 can be made at the same thickness as the inner and outer shells.

When the outer shells of the cabinet are burned away by fire exposing outer surfaces of the insulation materials 26 and 28, there is little area of the resin material in the jamb regions that is also exposed to the fire. Even if the outermost portion of the jamb region is also burned away, the resulting gap between the insulation materials 26 and 28 is too narrow to support a substantial convection air current within the gap. Accordingly, the amount of heat energy that can become concentrated in the frame 16 at the top of the jamb regions is greatly reduced, and the damaging results of the chimney effect are thereby avoided.

Although the resin material of the jamb regions is made very thin, the resin material of the other portions of the integral resin shells of the safe body and closure is made at a conventional thickness. In addition to forming both interior and exterior surfaces of the main body 10 and drawer head 12, the integral resin shells are used as shuttering for molding the insulation materials 26 and 28 in place within the main body and drawer head. The insulation material is a heavy viscous substance that is poured into cavities within the resin shells and is allowed to gradually harden within the shells to a desired form. Accordingly, the resin shells must be made of sufficient thickness to support the insulation material until it solidifies. However, even after the resin material has completely cured to a solid state, the integral resin shells must provide sufficient structural support to protect the insulation material from damage due to shock or vibration. It is expected that by limiting the reduction in thickness of the resin shells to the jamb regions, the structural strength of the resin shells will not be significantly affected.

Conventional blow molding practices such as those disclosed in commonly assigned U.S. Pat. No. 4,828,786 can be used to mold the integral resin shells of the main body and drawer head. The thinner jamb regions of the resin shells can be formed according to the well-known practice of regulating the thickness of selected portions of an extruded parison. However, it would also be possible to mold the jamb regions at a conventional thickness and to remove excess resin material from the jamb regions by a subsequent abrasive operation.

Figure 5:
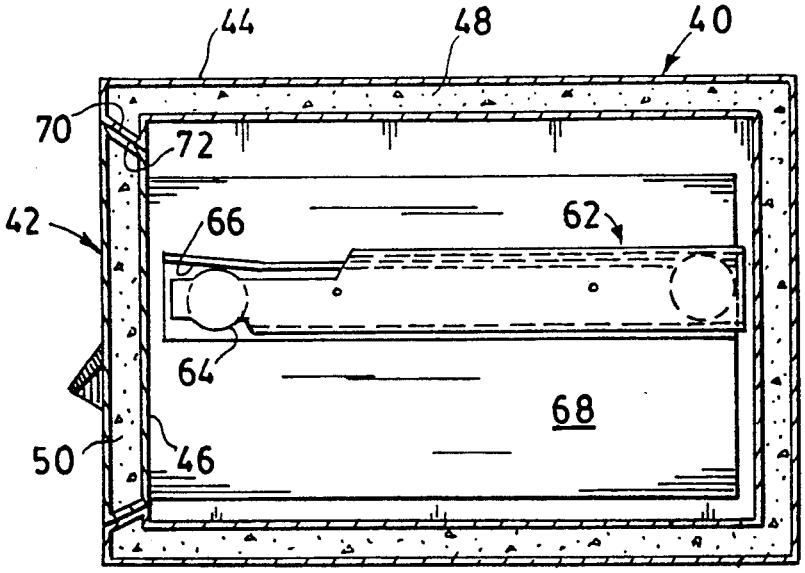
FIG. 5 is a vertical cross-sectional side view of a similarly appearing cabinet having uniformly thick resin shells and a drawer glide with means for exerting a compressive force between abutting surfaces of the drawer head and main body.
Figure 6:
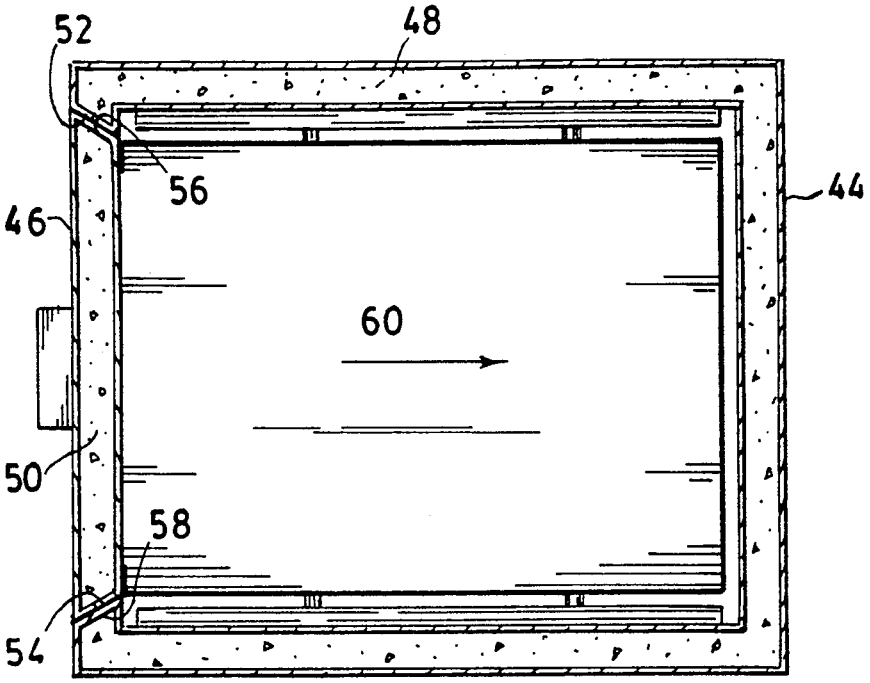
FIG. 6 is a horizontal cross-sectional view through the cabinet of FIG. 5 showing the abutting surfaces of the jamb region.
Figure 7:
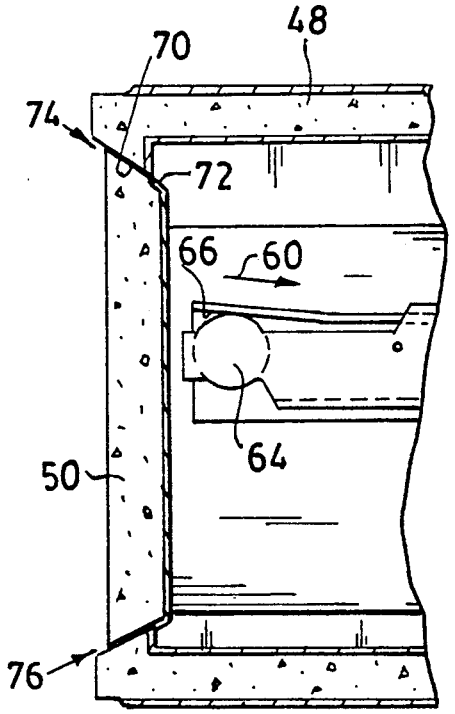
FIG. 7 is an enlarged cross-sectional side view of a portion of FIG. 5 as the cabinet might appear after the front face of the cabinet has been exposed to fire and the drawer head has been urged into a position that closes a gap between insulation materials of the main body and drawer head.

Another embodiment of our invention, illustrated by FIGS. 5 through 7, provides for dynamically reducing any gap that might otherwise be burned into the jamb regions between insulation materials of a safe body and closure. FIG. 5 depicts a cross-sectional side view of a similarly appearing fire-resistant file cabinet having a main body 40 with an opening that can be closed by a drawer head 42. Both the main body 40 and the drawer head 42 are formed by integral resin shells 44 and 46 that are respectively filled with insulation materials 48 and 50.

In the horizontal cross-sectional view of FIG. 6, it can be seen that intermediate portions of the integral resin shells 44 and 46 form respective jambs 52 and 54 of the main body and confronting portions 56 and 58 of the drawer head. In contrast to the preceding embodiment, the jamb regions of the main body and drawer are made at substantially the same thickness as the other portions of the resin shells. However, the jambs 52 and 54, together with the confronting portions 56 and 58, are oriented at an angle to a direction 60 along which the drawer is closed. Accordingly, the jambs 52 and 54 form a stop against which the confronting portions 56 and 58 are abutted when the drawer is closed.

The drawer head 42 is mounted in the main body 40 on a conventional drawer glide 62 that includes a roller 64 supported on a side wall of the main body 40 and an inclined camming rail 66 carried on a drawer side member 68. A compressive force imparted by the weight of the drawer head acting through the roller 64 and camming rail 66 urges the peripheral region 71 of the drawer head against the frame 72 of the main body. For example, in the enlarged side view of FIG. 7, the file has been exposed to fire, and the resin material of the jamb region has softened so that the compressive force urges the drawer head 42 in the direction of arrow 60. Movement of the drawer head against the main body squeezes the molten resin of the peripheral region 70 and frame 72 together to fill any gaps that begin to form between the insulation materials 48 and 50 of the main body and drawer head. The inclined camming rail 66 along with the roller 62 defines a predetermined length of travel between the drawer head and main body. The range of travel includes a relative position between the drawer head and main body at which the respective insulation materials 48 and 50 are substantially in contact with each other.

The compressive force acting on the resin material in the jamb region resists the formation of convection air currents within the jamb region in two ways. First, the compressive force squeezes molten resin material into the gap left by combusted resin material near the exposed surface of the jamb region. Second, the relative movement between the main body and drawer head narrows any remaining space between the respective insulation materials within which a convection air current could be formed.

Although the direction of arrow 60 along which the drawer head is moved is inclined slightly to horizontal, it is possible to close gaps between the insulation materials 48 and 50 at both the top and bottom of the opening in the front wall at substantially equal rates by inclining the respective abutting surfaces 74 and 76 at the top and bottom of the opening by substantially equal but opposite amounts with respect to the direction of arrow 60. As a result, the abutting surfaces 74 and 76 are inclined by different amounts to the horizontal plane—the inclination angle of the direction 60 to horizontal adding to the inclination of abutting surfaces 74 to horizontal and subtracting from the inclination of abutting surfaces 76 to horizontal. The similarly abutting surfaces 52, 56 and 54, 58 of the jamb regions on opposite sides of the opening are also inclined by equal but opposite amounts to a horizontal component of the direction 60. However, since the effective movement of the abutting surfaces in the jamb region is limited to the horizontal component of the direction 60, the inclination angles of the abutting surfaces of the jamb regions must be slightly larger than the inclination angles of the abutting surfaces at the top and bottom of the opening, each measured a described against the direction 60.

The depicted drawer glide arrangement is only one of many ways in which a compressive force may be applied between a safe body and closure for the purposes of our invention. For example, a variety of known manually actuated or automatic spring biasing mechanisms could be used to urge the safe body and door together through the prescribed distance. However, it is important that the magnitude of the compressive force imparted by any of these mechanisms is sufficient to at least partially deform the resin material in a plasticized state prior to melting of the resin material into a liquid state.

We claim:

1. A fire-resistant safe for protecting contents from fire comprising:

a main body formed by an integral resin shell filled with insulation material;

a closure formed by another integral resin shell filled with insulation material;

each of said integral resin shells including an outer shell, an inner shell, and an intermediate shell;

said intermediate shell of the main body forming jambs along vertical sides of an opening in a front wall of said main body;

said intermediate shell o the closure forming confronting portions that fit together with said jambs for closing said opening;

said jambs of the safe body and said confronting portions of the closure defining a jamb region;

means for resisting formation of destructive convection air currents in said jamb region when said front wall of the safe is exposed to the first;

said means for existing destructive convection air currents including forming the jamb region of at least one of said intermediate shells with a thinner cross-sectional thickness than said inner and outer shells of the same integral resin shell for narrowing a space between the respective insulation materials o the main body and closure within the jamb region; and both said jambs and said confronting portions of the respective intermediate shells being molded thinner in cross-sectional thickness than said inner and outer shells of both the main body and the closure.

2. IN a fire-resistant safe for protecting contents from fie of the type including a main body and a closure, both of which are constructed from integral resin shells filled with insulation materials; said integral resin shells include inner and outer shells joined by respective intermediate shells that form a frame surrounding an opening in a front wall of said main body and a peripheral region surrounding said closure; said frame includes jamb members enclosing vertical sides o the opening and said peripheral region includes confronting portions adjacent so said jamb members; said jamb members along with said confronting portions define jamb regions between said main body and closure; and when said safe is exposed to the fire, portions of said external shells burn away and gap begin to form in said jamb regions between respective insulation materials of the safe body and closure; at the improvement in which:

said safe is constructed with means for reducing conventional spacing in the jamb regions between respective insulation materials of the main body and closure so that any gaps between the insulation materials by burning away resin material int eh jamb regions are too narrow to promote significant convection air flows in the jamb regions; and said means for reducing conventional spacing includes forming the jamb regions of said intermediate shells thinner in cross-sectional thickness than said inner and outer shells of respective integral resin shells.

3. The safe of claim 2 in which said inner and outer shells are made with sufficient cross-sectional thickness to provide necessary structural strength for molding said insulation materials in place within the integral resin shells.

* * * * *

UNITED STATES PATENT AND TRADEMARK OFFICE

CERTIFICATE OF CORRECTION

PATENT NO. : 5,152,231

DATED : October 6, 1992

INVENTOR(S) : Mark E. Preston and Eugene S. Stephens

It is certified that error appears in the above-indentified patent and that said Letters Patent is hereby corrected as shown below:

On the title page, under item [19], after Preston, delete "et al."; and item [75], change "Inventors" to --Inventor-- and after Fairport insert --,-- and delete "; Eugene S. Stephens, Ontario, both of".

Signed and Sealed this

Fourteenth Day of December, 1993

*Attest:*

*Attesting Officer*

BRUCE LEHMAN

*Commissioner of Patents and Trademarks*